US008196916B2

(12) United States Patent
Yanagida et al.

(10) Patent No.: US 8,196,916 B2
(45) Date of Patent: Jun. 12, 2012

(54) BANKNOTE DEPOSITING UNIT AND INSERT/RETURN UNIT ATTACHABLE TO AND DETACHABLE FROM BANKNOTE DEPOSITING UNIT

(75) Inventors: Hiroshi Yanagida, Inagi (JP); Kazuhisa Yoshimura, Inagi (JP)

(73) Assignee: Fujitsu Frontech Limited, Tokyo (JP)

( * ) Notice: Subject to any disclaimer, the term of this patent is extended or adjusted under 35 U.S.C. 154(b) by 0 days.

(21) Appl. No.: 13/011,207

(22) Filed: Jan. 21, 2011

(65) Prior Publication Data

US 2011/0115145 A1 May 19, 2011

Related U.S. Application Data

(63) Continuation of application No. PCT/JP2008/002617, filed on Sep. 22, 2008.

(51) Int. Cl.
*B65H 83/00* (2006.01)

(52) U.S. Cl. ..... 271/3.14; 271/3.18; 271/225

(58) Field of Classification Search ..... 271/3.14, 271/3.18, 3.19, 10.01, 225
See application file for complete search history.

(56) References Cited

U.S. PATENT DOCUMENTS

| | | | |
|---|---|---|---|
| 5,662,201 | A | 9/1997 | Gerlier et al. |
| 5,909,792 | A | 6/1999 | Gerlier et al. |

FOREIGN PATENT DOCUMENTS

| | | |
|---|---|---|
| JP | 63-146193 | 6/1988 |
| JP | 63-231589 | 9/1988 |
| JP | 06-290330 | 10/1994 |
| JP | 2575381 | 10/1996 |
| JP | 2001-076206 | 3/2001 |
| JP | 2001-134840 | 5/2001 |
| JP | 3302504 | 4/2002 |
| JP | 2003-308552 | 10/2003 |
| JP | 3710137 | 8/2005 |
| JP | 2005-258353 | 9/2005 |
| JP | 2006-107356 | 4/2006 |

OTHER PUBLICATIONS

Int'l. Search Report issued in Int'l. App. No. PCT/JP2008/002617, mailed Dec. 16, 2008.

*Primary Examiner* — Michael McCullough
(74) *Attorney, Agent, or Firm* — Greer, Burns & Crain, Ltd.

(57) ABSTRACT

A banknote depositing unit can be made with a smaller width than those made previously. The unit includes: a first conveying section for conveying banknotes or a bundle of banknotes deposited into a temporary holding section from an inlet through a first route; a second conveying section for conveying each banknote from the bundle of banknotes held in the temporary holding section to a return outlet through a second route; and a third conveying section for conveying each bundle of banknotes held in the temporary holding section to a cassette section where the banknotes are to be stored in each bundle through a third route. The second route and the third route commonly have the temporary holding section as a starting point and three-dimensionally intersect each other.

7 Claims, 11 Drawing Sheets

ESCROW SECTION PERSPECTIVE VIEW

BANKNOTE DEPOSITING UNIT AND INSERT/RETURN UNIT ATTACHABLE TO AND DETACHABLE FROM BANKNOTE DEPOSITING UNIT

CROSS-REFERENCE TO RELATED APPLICATIONS

This application is a continuation application of International PCT Application No. PCT/JP2008/002617 which was filed on Sep. 22, 2008.

FIELD

The present invention relates to a banknote depositing unit as a unit attachable to and detachable from an ATM (automatic teller machine) and a deposit-only machine, and an insert/return unit attachable to and detachable from the depositing unit.

BACKGROUND

When an ATM, a deposit-only machine, and the like are installed in facilities such as a convenience store or the like, there are strict requirements for the width of the machine. There are also strict requirements for the width of a banknote depositing unit that is attachable to and detachable from the machine.

In this case, it is preferable that the banknote deposit direction be able to be switched as necessary.

As an example of peripheral technology, patent document 1 discloses an automatic teller machine with a smaller depth dimension achieved by setting the banknote conveyance direction as being in the width dimension of the machine.

Patent document 2 discloses a rotating mechanism for switching the banknote conveyance direction in a banknote depositing device.

Patent Document 1: Japanese Laid-open Patent Publication No. 63-231589

Patent Document 2: Japanese Laid-open Patent Publication No. 2001-76206

SUMMARY

The present invention aims to provide a banknote depositing unit with a smaller width dimension than that of previously available banknote depositing units.

The proposed banknote depositing unit includes: a first conveying section for conveying banknotes or a bundle of banknotes deposited into a temporary holding section from an inlet through a first route; a second conveying section for conveying each banknote from the bundle of banknotes held in the temporary holding section to a return outlet through a second route; and a third conveying section for conveying each bundle of banknotes held in the temporary holding section to a cassette section where the banknotes are to be stored in each bundle through a third route.

In the first route and the second route, the first conveying section and the second conveying section convey banknotes in the directions of the dimension orthogonal to the longitudinal dimension of the banknotes, in the width dimension and the vertical dimension of the depositing unit. In the third route, after the bundle of banknotes is conveyed by the third conveying section within the longitudinal dimension of the bundle toward the front or the back in the depth dimension of the depositing unit, it is conveyed within the longitudinal dimension of the bundle in the downward direction with respect to the orientation of the unit and with the longitudinal dimension of the banknotes set as the vertical dimension, toward the front of the depth dimension of the cassette section.

With the proposed banknote depositing unit, when banknotes are conveyed from the temporary holding section to the return outlet, the banknotes are conveyed within the dimension orthogonal to the longitudinal dimension, and when the banknotes are conveyed from the temporary holding section to the cassette section, the banknotes are conveyed within the longitudinal dimension. Therefore, the conveying route (third route) from the temporary holding section to the cassette section refers to a route traversing through the depth dimension and heading downward, with the range of the width dimension set as a fixed range corresponding to the length of the dimension orthogonal to the longitudinal dimension of the banknotes, and the conveying route (second route) from the temporary holding section to the return outlet refers to a route traversing through the width dimension and vertical dimension (essentially upward) with the range of the width dimension set as a fixed range corresponding to the length of the longitudinal dimension of the banknotes.

Therefore, the second and third routes three-dimensionally intersect each other, and a smaller width dimension, on which strict demands are placed, can be realized even if the depth dimension of the unit becomes bigger.

DESCRIPTION OF EMBODIMENTS

An embodiment of the present invention is described below in detail with reference to the attached drawings.

The present invention relates to a banknote depositing unit (hereinafter referred to as a "depositing unit") attachable to and detachable from an ATM (automatic teller machine) and a deposit-only machine, and an insert/return unit attachable to and detachable from the depositing unit.

Figure 1:
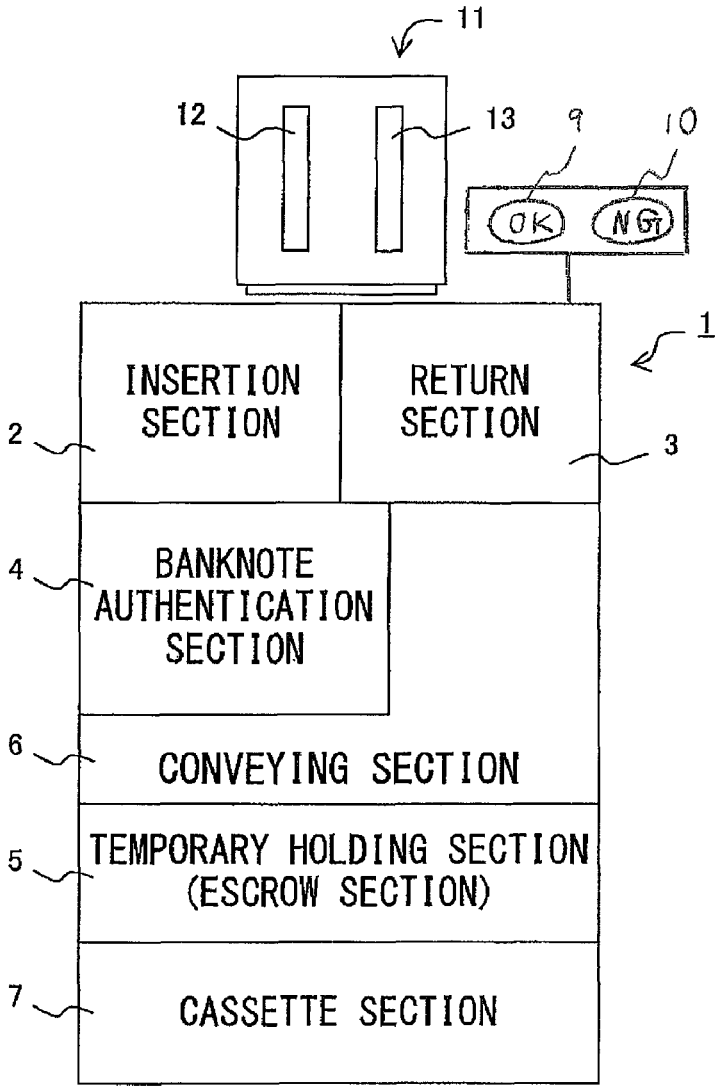
FIG. 1 is a front view illustrating the outline of the configuration of a depositing unit with an insert/return unit attached according to an embodiment of the present invention.

FIG. 1 is a front view illustrating the outline of the configuration of a depositing unit with an insert/return unit attached.

In FIG. 1, a depositing unit 1 is configured with an insertion section 2 provided with an inlet for banknotes, a return section 3 provided with a return outlet for banknotes, a banknote authentication section 4 for authenticating each of the inserted banknotes, a temporary holding section (also referred to as an escrow section) 5 for temporarily holding true banknotes from among the inserted banknotes, a conveying section 6, and a cassette section 7 for storing the banknotes from the temporary holding section 5.

The conveying section 6 conveys banknotes between the banknote authentication section 4 and the temporary holding section 5, between the banknote authentication section 4 and the return section 3, and between the temporary holding section 5 and the return section 3. Although not illustrated in FIG. 1, a conveying mechanism is provided between the temporary holding section 5 and the cassette section 7 in FIG. 1.

The insert/return unit 11 is used when the banknote deposit direction is to be changed in, for example, an ATM in which the depositing unit is installed. The insert/return unit 11 is provided with an inlet 12 for one or more banknotes on the left and a return outlet 13 for the banknote(s) on the right. When the insert/return unit 11 is not installed, a banknote inlet 15 is provided at the position corresponding to the inlet 12 of the insert/return unit 11 on the top surface of the depositing unit 1 as illustrated in FIG. 2A, and a banknote return outlet 16 is provided at the position corresponding to the return outlet 13 of the insert/return unit 11.

Figure 2A:
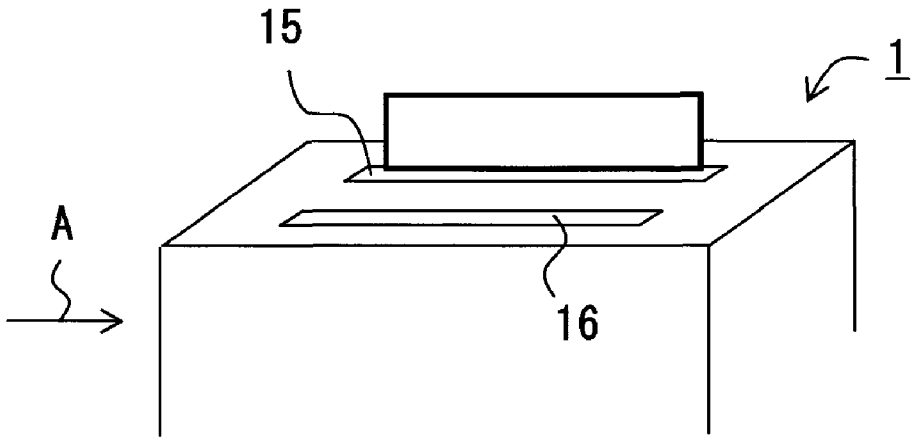
FIG. 2A illustrates a method of inserting a banknote into a depositing unit without attaching an insert/return unit.
Figure 2B:
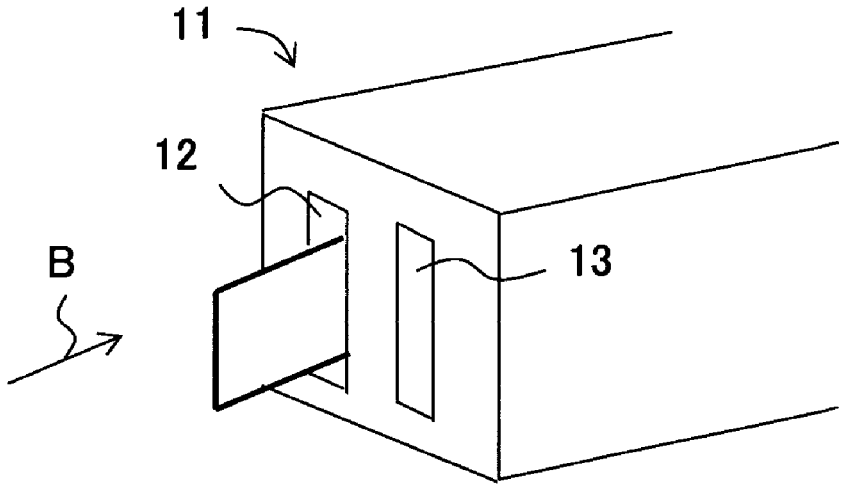
FIG. 2B illustrates a method of inserting a banknote into a depositing unit with an insert/return unit attached.

FIG. 1 is a front view from the vantage of the arrow A in FIG. 2A or the vantage of the arrow B in FIG. 2B.

To insert a banknote into the depositing unit provided with the insert/return unit, the dimension perpendicular to the banknote surface must match the width dimension of, for example, the ATM as illustrated in FIG. 2B so that the longitudinal dimension of (one or more) banknotes can be directed toward the back in the depth dimension of the ATM, thereby allowing the banknote(s) to be inserted from the inlet 12.

On the other hand, when a banknote is inserted into the depositing unit without the insert/return unit, the dimension perpendicular to the banknote surface must match the width dimension of, for example, the ATM as illustrated in FIG. 2A so that the dimension orthogonal to the longitudinal dimension of (one or more) banknotes can be directed vertically downward in the orientation of the ATM, thereby allowing the banknote(s) to be inserted from the inlet 15

Figure 3A:
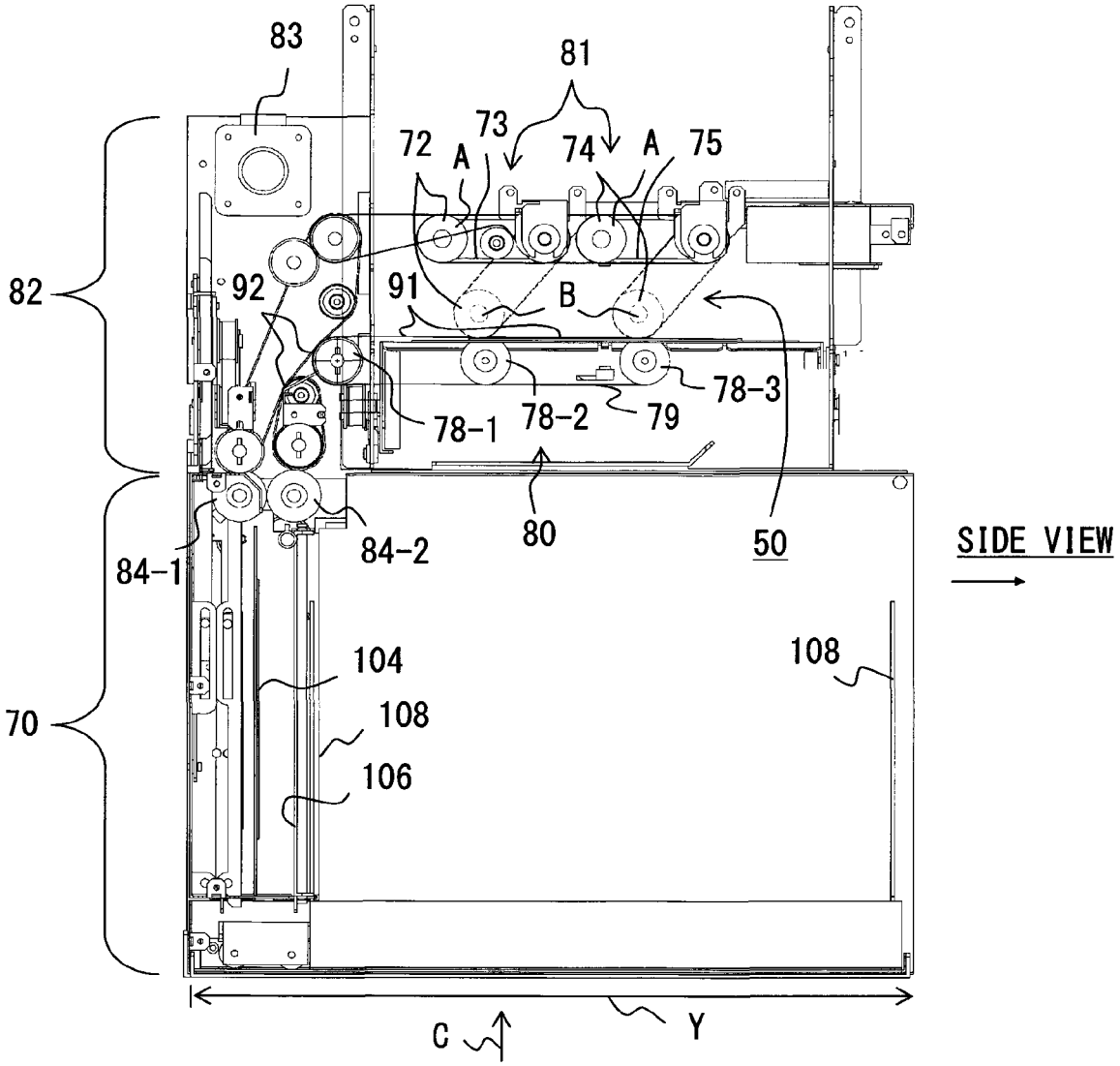
FIG. 3A is a detailed front view.
Figure 3B:
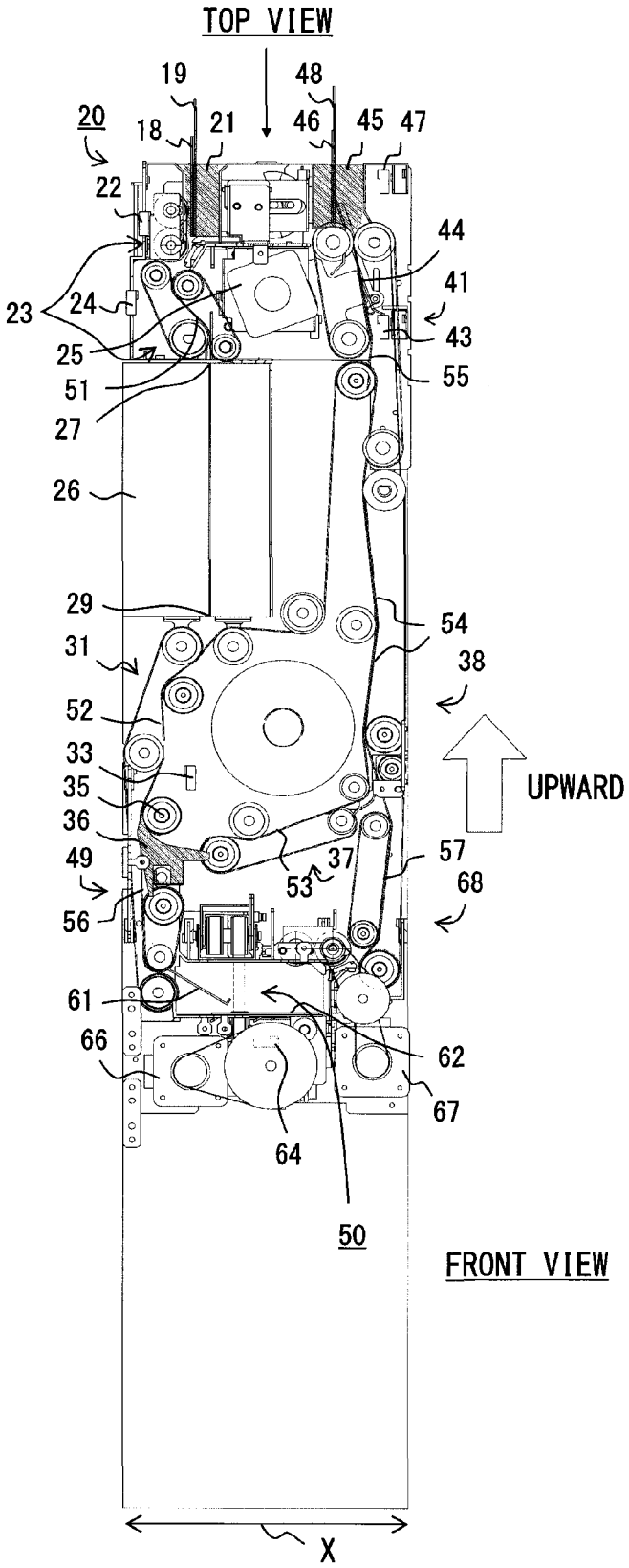
FIG. 3B is a side view of the depositing unit illustrated in FIG. 1.

FIG. 3 is a detailed front view and a side view of the depositing unit illustrated in FIG. 1. In FIG. 3, the dimension Y indicates the depth dimension of the depositing unit, and the dimension X indicates the width dimension of the depositing unit.

In FIG. 3, a user inserts (deposits) one or more banknote(s) in the depositing process into an inlet area 21 (also referred to as an "inlet" and indicated by the diagonal hatching in FIG. 3) of a depositing unit 20.

For example, a bundle 19 of banknotes is placed against a standing plate 18 of the inlet area 21 when it is inserted. An inlet banknote detection sensor (transmission sensor) 22 detects the insertion of the bundle 19 of banknotes. Each banknote of the inserted bundle 19 of banknotes is fed to a route 51 by a feeding mechanism 23 configured with a plurality of conveying rollers and a plurality of belts.

In this case, a feeding timing sensor 24 detects a banknote fed through the inlet area 21, and notifies a banknote authentication section 26 of the feeding. The fed banknote is further conveyed by the feeding mechanism 23 into the banknote authentication section 26 through an entrance 27 of the banknote authentication section 26.

A feeding motor 25 drives a feeding mechanism 23 and a feeding mechanism 41 described later.

The banknote authentication section 26 authenticates a banknote by, for example, acquiring image data of the banknote by an image sensor (not illustrated in the attached drawings). When the banknote authenticating process is completed by the banknote authentication section 26, the banknote is fed from an exit 29 of the banknote authentication section 26 to a route 52, and conveyed on the route 52 by a feeding mechanism 31 configured with a plurality of conveying rollers and a plurality of belts.

When the banknote arrives at the position of a gate timing sensor 33, the gate timing sensor 33 detects the conveyance of the banknote on the route 52, and at the same time a switch gate 36 rotates around the center, not illustrated in the attached drawings, on the basis of the authentication result acquired by the banknote authentication section 26 on the banknote.

The position illustrated in FIG. 3 corresponds to the position of the switch gate 36 when the authentication result indicates a false note. In this case, the orientation of the banknote conveyed on the route 52 is changed by the switch gate 36 so that the banknote can be conveyed on a route 53, and is conveyed on the route 53 by a conveying mechanism 37 configured with a plurality of conveying rollers and a plurality of belts, on a route 54 by a conveying mechanism 38, and on a route 55 by the feeding mechanism 41.

When the banknote reaches the position of a rejecting conveyance detection sensor 43 during the conveyance on the route 55, the rejecting conveyance detection sensor 43 detects the rejection of the banknote. Then, the banknote is fed to a return outlet area (also referred to as a "return outlet", and indicated by the diagonal hatching) 45 where the banknote to be returned is conveyed from the route 55 by the feeding mechanism 41.

A fed banknote 48 is enclosed by a standing plate 46 of the return outlet area 45 and a holding plate 44. As illustrated in FIG. 3, the depth of the return outlet area 45 is actually smaller than the depth of the inlet area 21. Therefore, the banknote(s) enclosed by the standing plate 46 and the holding plate 44 juts out of the top surface of the depositing unit 20 orthogonally to the longitudinal dimension of the banknote(s).

In this case, a return outlet banknote detection sensor (transmission sensor) 47 detects that there is a banknote in the return outlet area 45.

On the other hand, when the banknote authentication section 26 authenticates the banknote, the switch gate 36 moves to the position it takes after the rotation around the center, not illustrated in FIG. 3, the rotation being clockwise. At this new position, a part of the switch gate 36 looks from the front view as though it overlaps a conveying roller 35.

In this case, the banknote conveyed on the route 52 is conveyed on a route 56 by a feeding mechanism 49, fed to a temporary holding section (escrow section) 50, and pushed against the lower end of the escrow section 50 which is provided with a stage 62 that is movable vertically. In FIG. 3, the direction vertically upward is indicated by an arrow as the "upward direction". The escrow section 50 is a hollow section capable of storing bundles of banknotes whose lower end is determined by the stage 62 that is movable vertically.

In the depositing process, the number of deposited banknotes is for example displayed on the screen. If the user selects an "OK Button 9", the banknotes are moved from the escrow section 50 to a cassette section 70. However, when the number of deposited banknotes does not match the number on the screen display, the user selects an "NG Button 10", and the deposited banknotes are moved and returned from the escrow section 50 to the return outlet area 45.

First, the case in which banknotes are returned from the escrow section 50 to the return outlet area 45 is described below.

In this case, a stage operation motor 66 of the escrow section 50 moves the stage 62 upward, and pushes one or more banknotes in the escrow section 50 against the upper end of the escrow section 50. A feeding mechanism 68 (driven by a feeding motor 67) feeds each of the banknotes from the escrow section 50 to a route 57, and the conveying mechanism 38 conveys the banknotes on the route 54 as described above. Then, the banknotes reach the return outlet area 45 through the route 55.

Described next is the conveyance of banknotes from the escrow section 50 to the cassette section 70. It corresponds to, for example, a user selecting the OK button in the above-mentioned depositing process.

In this case, in the front view in FIG. 3, bundles of banknotes are piled up oriented orthogonal to the longitudinal dimension of the bundles viewed in the escrow section 50. Each bundle of banknotes is fed upward perpendicular to the front view in FIG. 3, that is, toward the front in the depth dimension of, for example, an ATM. Then, the orientation of the bundle of banknotes is changed to vertically downward, that is, the bundle of banknotes is conveyed while drawing a locus of jumping into the cassette section 70.

Then, the longitudinal side of the banknotes is placed vertically in the ATM, the bundle of banknotes reach the front in the depth dimension of the ATM of the cassette section 70, and the pushing mechanism of the cassette section 70 pushes the bundle of banknotes from this position toward the back in the depth dimension of the ATM.

That is, the conveying route formed by the routes 57, 54, and 55 from the escrow section 50 as a starting point to the return outlet 45, and the conveying route formed by the routes 91 and 92 to the cassette section 70 are not arranged on the same plane, and three-dimensionally intersect each other.

The process of conveying the bundle of banknotes from the escrow section 50 to the cassette section 70 is further described below with reference to the side view in FIG. 3 and FIGS. 4, 5A, and 5B.

When the user selects the OK button in the depositing process, upper conveying rollers 72 and 74 and upper conveying rollers 73 and 75, which are placed in the lay-by position A in a bundle conveying section 82, are moved to the position B to enclose the bundle of banknotes of the escrow section 50. Thus, the bundle of banknotes is enclosed by a conveying mechanism 80 configured with lower conveying rollers 78-1, 78-2, and 78-3 provided on the lower end of the escrow section 50 and a lower conveying belt 79, and a conveying mechanism 81 including the upper conveying rollers 72 and 74 and the upper conveying rollers 73 and 75. Then, a conveying motor 83 drives the conveying mechanisms 80 and 81, and the bundle of banknotes is conveyed through routes 91 and 92, passes through conveying rollers 84-1 and 84-2 positioned at the entrance of the cassette section 70, and is fed into the cassette section 70

Figure 4:
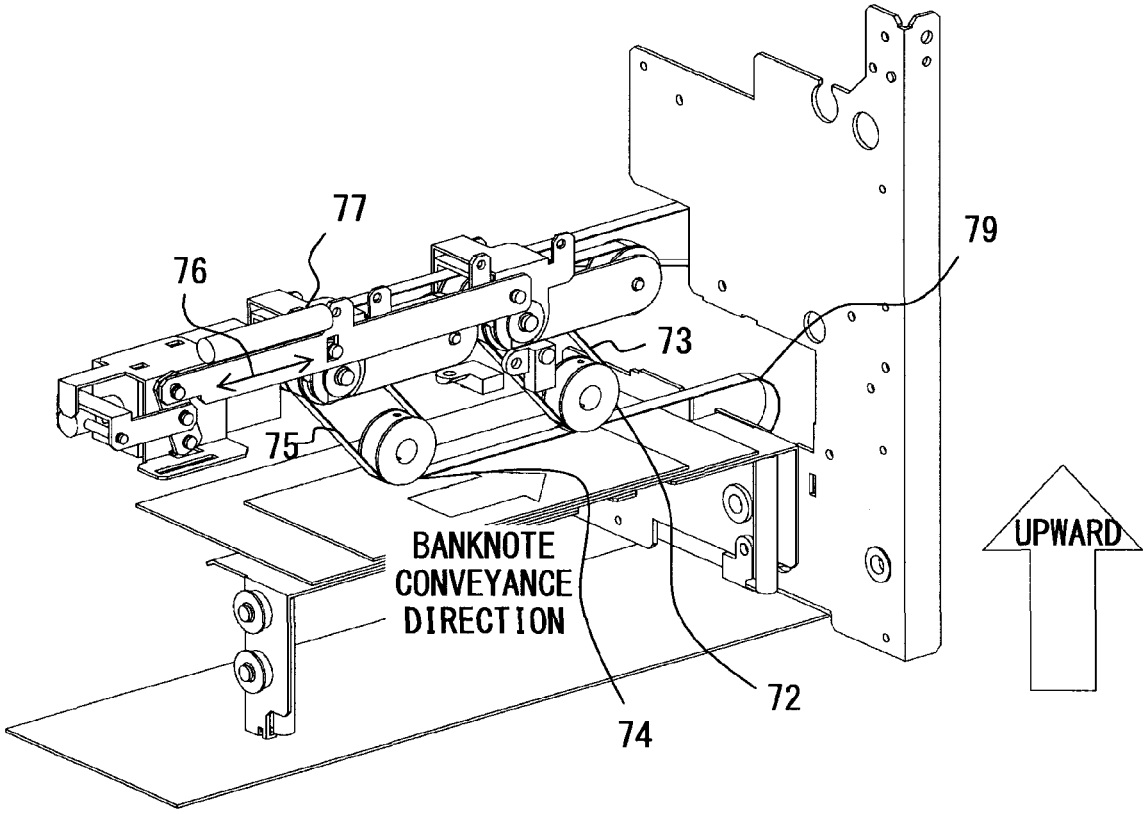
FIG. 4 is a perspective view including an escrow section.

As illustrated in FIG. 4, the upper conveying rollers 73 and 75 can be moved to the position B shown in the side view in FIG. 3 by moving a link (for pushing the upper conveying roller) 76 in the same direction as the banknote conveyance direction. The recovery from the position B to the position A in the side view in FIG. 3 is realized by moving the link 76 in FIG. 4 in the direction opposite the banknote conveyance direction by the operation of a link recovery spring 77. In FIG. 4, the upward direction of the ATM is indicated by an arrow as the "upward direction".

Figure 5A:
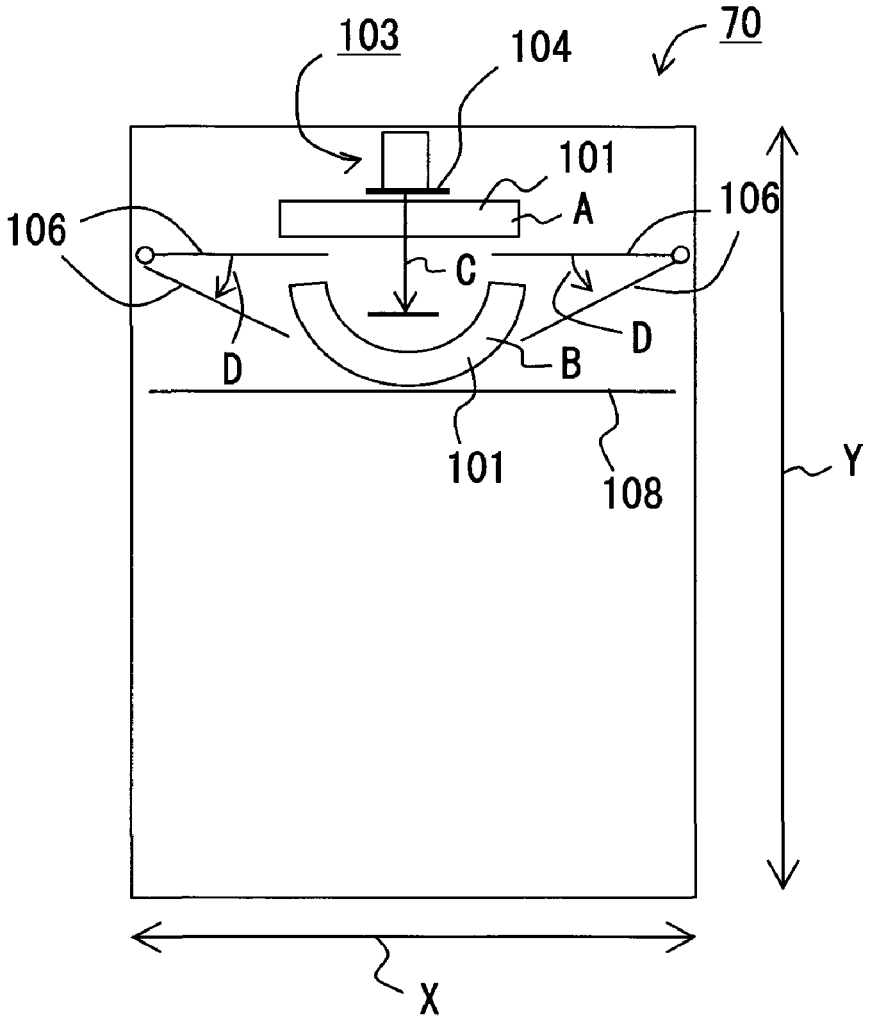
FIG. 5A is a sectional view (1) of a cassette section viewed from the vantage of the arrow C illustrated in the side view in FIG. 3.
Figure 5B:
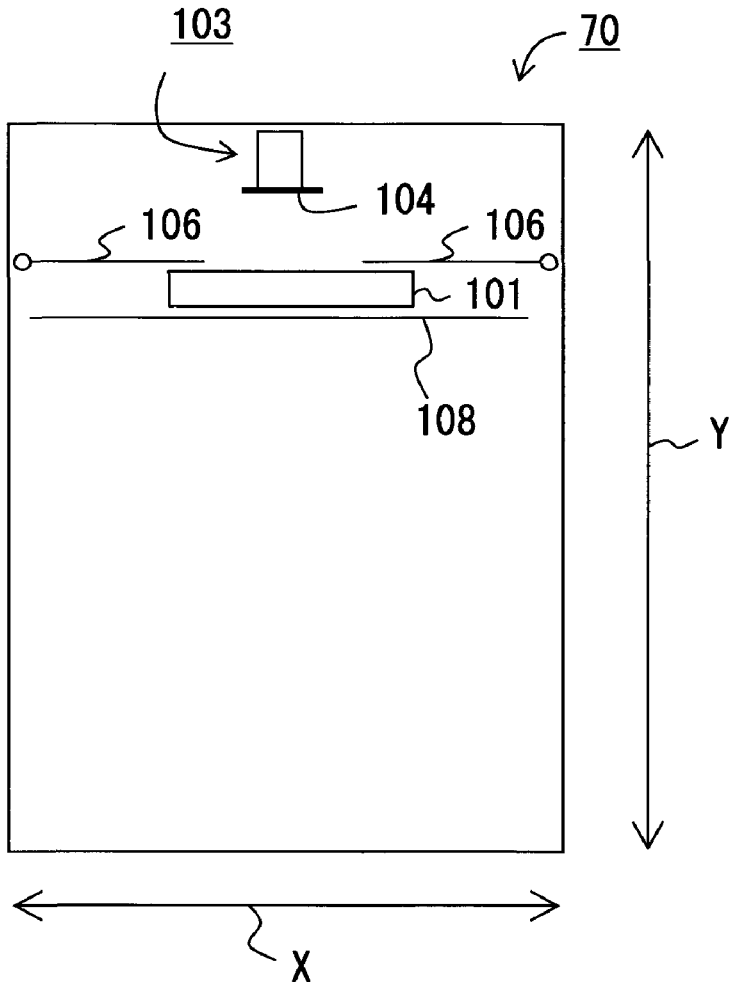
FIG. 5B is a sectional view (2) of a cassette section viewed from the vantage of the arrow C illustrated in the side view in FIG. 3.

FIGS. 5A and 5B are sectional views of the cassette section viewed from the vantage of the arrow C in the side view in FIG. 3.

In FIGS. 5A and 5B, the dimension Y indicates the depth dimension of the depositing unit, and the dimension X indicates the width dimension of the depositing unit. The top of the figure in FIGS. 5A and 5B corresponds to the front of the ATM.

A bundle 101 of banknotes conveyed by the bundle conveying section 82 to the frontmost position in the depth dimension of the cassette section 70 is enclosed by a door 106 rotating in the direction of the arrow D in FIG. 5A and by a holding plate 104 of a banknote pushing mechanism 103 when pressure at a predetermined level or higher is applied backward in the depth dimension (direction of the arrow C in FIG. 5A) of the ATM in the initial state in which the bundle of banknotes is conveyed to the frontmost position.

In the state in which the holding plate 104 of the banknote pushing mechanism 103 moves backward in the depth dimension (direction of the arrow C in FIG. 5A) of the ATM and applies pressure to the bundle 101 of banknotes, the pressure allows the bundle 101 of banknotes to move from the position A toward the back in the depth dimension of the ATM while being depressed at the center and to reach the position B. Correspondingly, the door 106 also rotates toward the back in the depth dimension of the ATM (direction of the arrow D in FIG. 5A).

When the bundle 101 of banknotes further moves toward the back from the position B, neither side in the dimension orthogonal to the longitudinal dimension of the bundle 101 of banknotes contacts a tip portion of each door 106. At this time, the door 106 returns to its original position via the operation of a spring not illustrated in the attached drawings, a stage 108 moves toward the front in the depth dimension of the ATM, as illustrated in FIG. 5B, and the bundle 101 of banknotes is enclosed between the stage 108 and the door 106 via the door 106 not rotating in the opposite direction of the arrow D in FIG. 5A, thereby completing the storage of the bundle 101 of banknotes in the cassette section 70.

Figure 6:
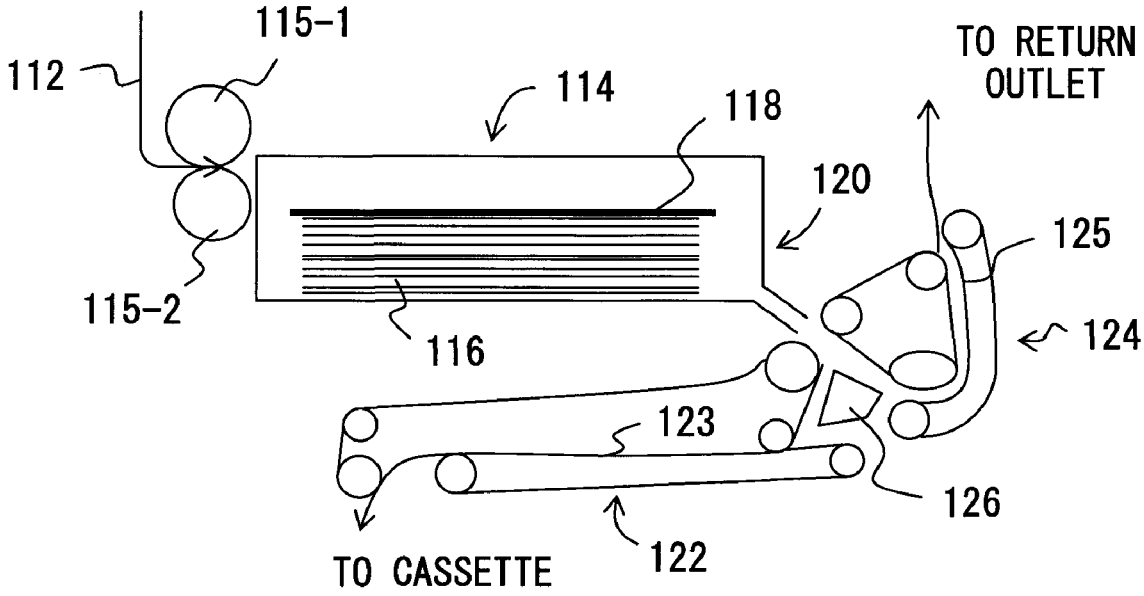
FIG. 6 is a sectional view of the vicinity of the escrow section of the conventional depositing unit for comparison with an embodiment of the present invention.

FIG. 6 is a sectional view of the vicinity of the escrow section of the conventional depositing unit, for comparison with the present embodiment.

In FIG. 6, each banknote is conveyed into an escrow section 114 through driving rollers 115-1 and 115-2 provided at the entrance of the escrow section 114. As a result, a bundle 116 of banknotes is piled into the escrow section 114. The bundle 116 of banknotes is pushed against the lower end of the escrow section 114.

An exit 120 of the escrow section 114 is used both when a banknote is conveyed to the cassette section (not illustrated in the attached drawings) and when it is conveyed to the return outlet (not illustrated in the attached drawings). Therefore, in addition to a route 123 to the cassette section via a conveying mechanism 122 and a route 125 to the return outlet via a conveying mechanism 124, it is necessary to provide a switch gate 126 for determining whether the route 123 or the route 125 is to be selected via the rotation around the center, not illustrated in the attached drawings.

Accordingly, the installation of the switch gate 126 increases the width dimension. As a result, it is difficult to install this system in a facility such as a convenience store or the like where limits on width are severe.

On the other hand, in the depositing unit according to the present embodiment, a banknote is conveyed within the dimension orthogonal to the longitudinal dimension when the banknote is conveyed from the escrow section 50 to the return outlet 45, and the banknote is conveyed within the longitudinal dimension when the banknote is conveyed from the escrow section 50 to the cassette section 70. Accordingly, the conveying route from the escrow section 50 to the cassette section 70 is a route in which a banknote is moved toward the back and downward with the range of the width dimension defined as a fixed range corresponding to the length of the banknote in the dimension orthogonal to the longitudinal dimension, and the conveying route from the escrow section 50 to the return outlet 45 is a route in which a banknote is moved in the width dimension and the vertical dimension (essentially upward) with the range of the depth dimension defined as a fixed range corresponding to the length in the longitudinal dimension of the banknote. Therefore, the conveying route from the escrow section 50 to the cassette section 70 and the conveying route from the escrow section 50 to the return outlet 45 three-dimensionally intersect each other, and the demanded smaller width dimension can be realized even if the depth dimension becomes bigger.

The insert/return unit attached as an option on the top surface of the depositing unit 20 is described below with reference to FIGS. 7 and 8.

Figure 7:
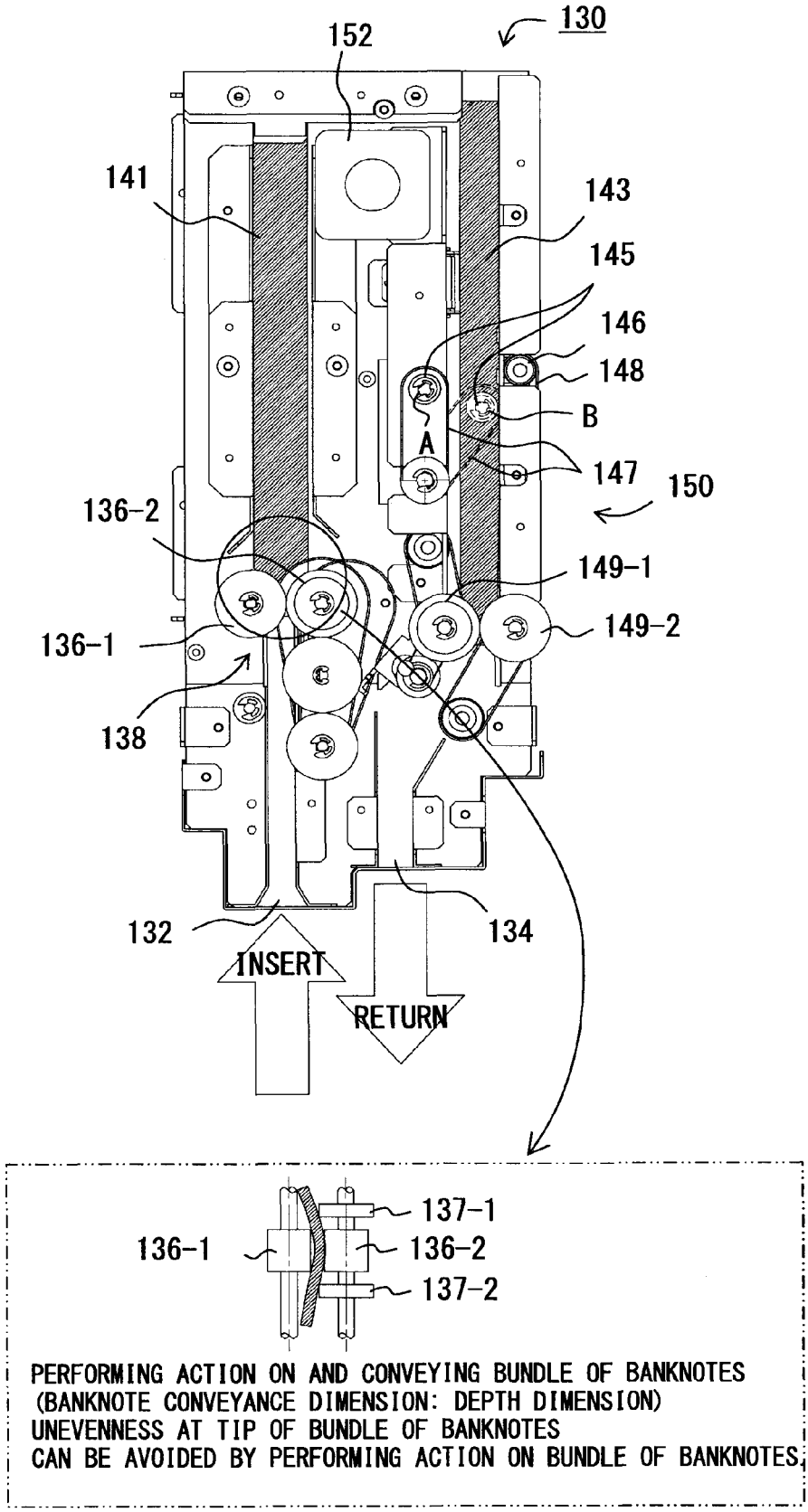
FIG. 7 is a top view of the insert/return unit.

FIG. 7 is a plan view of the insert/return unit. FIG. 8 is a perspective view of the outline of the insert/return unit.

Figure 8:
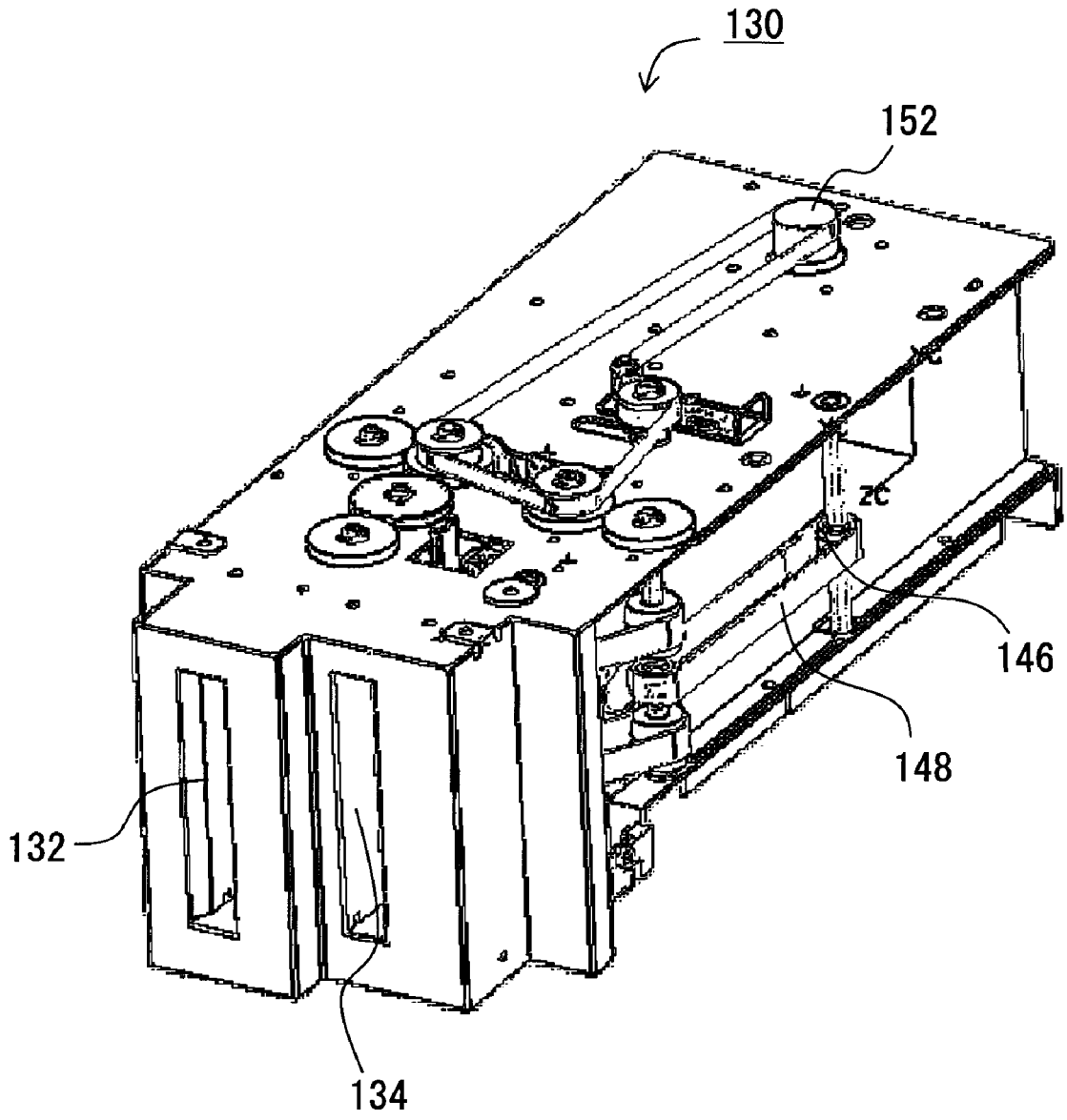
FIG. 8 is a perspective view of the outline of the insert/return unit.

As illustrated in FIGS. 7 and 8, an inlet 132 of an insert/return unit 130 is an opening provided on the left in the width dimension of the front of the insert/return unit 130 and having a height corresponding to the length of the banknote in the dimension orthogonal to the longitudinal dimension. A return outlet 134 is an opening provided on the right in the width dimension of the front of the insert/return unit 130 and having a height corresponding to the length of the banknote in the dimension orthogonal to the longitudinal dimension.

A banknote or a bundle of banknotes inserted in a longitudinal orientation into the inlet 132 in the depth dimension of the insert/return unit 130 is fed toward the back of the insert/return unit 130 in the depth dimension by a feeding mechanism 138 configured with a pair of conveying rollers 136-1 and 136-2, and reaches an inlet area 141 indicated by the diagonal hatching in FIG. 7. The inlet area 141 is hollow, and an opening is provided at the bottom corresponding to the inlet area 141, and a hollow portion extends continuously up to the inlet area 21 of the depositing unit 20. The banknote or the bundle of banknotes fed by the feeding mechanism 138 naturally drops into the inlet area 21 of the banknote depositing unit 20 via the operation of gravity when the banknote or the bundle of banknotes is disconnected from the pair of conveying rollers 136-1 and 136-2.

In the present embodiment, as illustrated in FIG. 7, one of the pair of conveying rollers 136-1 and 136-2 (the conveying roller 136-2 in FIG. 7) is provided with members 137-1 and 137-2 for depressing the central portion of the banknotes of the bundle of banknotes within the dimension orthogonal to the longitudinal dimension, coaxially with the conveying roller 136-2.

After an experiment, such an action performed on the bundle of banknotes as described above can prevent unevenness at the tip of the bundle of banknotes.

Described next is the case in which a banknote or a bundle of banknotes is to be returned through the insert/return unit 130.

As in the last case, a return outlet area 143 indicated by the diagonal hatching in FIG. 7 is hollow, an opening is provided at the bottom of the insert/return unit 130 corresponding to the return outlet area 143, and a hollow portion extends continuously up to the return outlet 45 of the depositing unit 20.

Therefore, as described above with reference to the front view in FIG. 3, the banknotes or the bundles of the banknotes enclosed by the standing plate 46 and the holding plate 44 and fed in orthogonally to the longitudinal dimension above the return outlet 45 of the depositing unit 20 are simultaneously positioned in the return outlet area 143 of the insert/return unit 130.

When the return outlet banknote detection sensor (not illustrated in the attached drawings) in the insert/return unit 130 detects, for example, a bundle of banknotes in the return outlet area 143 of the insert/return unit 130, a left conveying roller 145 and a left conveying belt 147 at the lay-by position A are moved to the position B where the bundle of banknotes in the return outlet area 143 is enclosed. Thus, the bundle of banknotes is enclosed by the conveying mechanism including a right conveying roller 146 and a right conveying belt 148 provided on the surface at the rightmost portion of the return outlet area 143 and by the conveying mechanism including the left conveying roller 145 and the left conveying belt 147. Then, a conveying motor 152 drives the conveying mechanisms, and the bundle of banknotes is conveyed toward the return outlet 134 through a pair of conveying rollers 149-1 and 149-2, and the bundle of banknotes is returned.

Thus, by attaching the insert/return unit 130, the banknote deposit direction can be switched as necessary. For example, the banknote deposit direction in a self-checkout system is mainly determined by attaching the insert/return unit 130.

In the explanation above, after a bundle of banknotes is fed toward the front in the depth dimension of the ATM from the escrow section, the bundle is fed downward to the front in the depth dimension of the cassette section. However, after the bundle of banknotes is fed toward the back in the depth dimension of the ATM from the escrow section, the bundle can be fed downward and fed toward the back in the depth dimension of the cassette section. In this case, the pushing mechanism of the cassette section pushes the bundle of banknotes toward the front in the depth dimension of the ATM.

What is claimed is:

1. A banknote depositing unit, comprising:

a first conveying section conveying one or more banknotes deposited in a temporary holding section, which holds the one or more banknotes as a bundle of banknotes from an inlet through a first route;

a second conveying section conveying each banknote from the bundle of banknotes held in the temporary holding section to a return outlet through a second route; and a third conveying section conveying each bundle of banknotes held in the temporary holding section to a cassette section where the banknotes are to be stored in each bundle through a third route, wherein:

in the first route and the second route, the first conveying section and the second conveying section convey banknotes within a dimension orthogonal to the longitudinal dimension of the banknotes in a width dimension and a vertical dimension of the depositing unit; and in the third route, after the bundle of banknotes is conveyed by the third conveying section within the longitudinal dimension of the bundle toward a front or a back in a depth dimension of the depositing unit, the bundle is conveyed within the longitudinal dimension of the bundle downward in the unit and with the longitudinal dimension of the banknotes set as the vertical dimension toward the front or the back of the depth dimension of the cassette section.

2. The unit according to claim 1, wherein a pushing mechanism of the cassette section pushes the bundle of banknotes toward the back or the front in the depth dimension of the depositing unit.

3. The unit according to claim 1, wherein:

the third conveying section further comprises an upper conveying mechanism for moving from a lay-by position to a position where the bundle of banknotes held in the temporary holding section is pressed upon when a deposited amount is displayed on a display screen and a confirmation instruction of the displayed amount is entered by a user by pressing a button, and for enclosing the bundle of banknotes with a lower conveying mechanism; and the conveying mechanisms convey the bundle of banknotes within the longitudinal dimension toward the front or toward the back in the depth dimension of the depositing unit.

4. The unit according to claim 1, wherein:

the inlet and the return outlet each have an opening having a depth corresponding to a length in the longitudinal dimension of the banknote on a top surface in the depth dimension on one or another side in a width dimension of the banknote depositing unit;

the depth of the return outlet is made to be smaller than the depth of the inlet so that a returned banknote or a bundle of banknotes can be fed to a position sufficiently high over the top surface in the return outlet of the banknote depositing unit; and the return outlet has a standing plate and a holding plate, the returned banknote or bundle of banknotes is enclosed by the standing plate and the holding plate, is displayed on a display screen and a confirmation instruction of the displayed amount is entered by a user by pressing a button mostly juts out of the top surface of the banknote depositing unit.

5. An insert/return unit detachably attached to the banknote depositing unit according to claim 4, comprising:

an opening of the inlet and an opening of the return outlet each having a height corresponding to the length of the banknote in the dimension orthogonal to the longitudinal dimension, and provided on one or another side in the width dimension of the front;

a first feeding mechanism feeding the banknote or the bundle of banknotes inserted from the opening of the inlet toward the back in the depth dimension, and feeding the banknote or the bundle of banknotes to an inlet area as a first hollow portion leading to a bottom of the insert/return unit; and a second feeding mechanism feeding toward the front in the depth dimension the banknote or the bundle of banknotes fed above the return outlet of the banknote depositing unit and positioned in a return area functioning as a second hollow portion leading to the bottom of the insert/return unit, and returning the banknote or the bundle of banknotes from the opening of the return outlet, wherein the first feeding mechanism encloses the banknote or the bundle of banknotes with a pair of conveying rollers, feeds the banknote or the bundle of banknotes to an inlet area toward the back in the depth dimension, and removes the banknote or the bundle of banknotes from the pair of conveying rollers, thereby naturally dropping the banknote or the bundle of banknotes into the inlet of the banknote depositing unit.

6. The unit according to claim 5, further comprising:

a return outlet banknote detection sensor for detecting a banknote remaining in the return area of the insert/return unit, a first conveying mechanism on one side of the width dimension moving from a lay-by position to a position where the banknote or the bundle of banknotes remaining in the temporary holding section can be pushed upon when the return outlet banknote detection sensor confirms that there is a banknote remaining in the return area of the insert/return unit, and a second conveying mechanism on another side in the width dimension with reference to the first conveying mechanism in which the banknote or the bundle of banknotes is enclosed via the first conveying mechanism, wherein the first and second conveying mechanisms convey the banknote or the bundle of banknotes within the longitudinal dimension toward the front in the depth dimension of the insert/return unit and return the banknote or the bundle of banknotes.

7. The unit according to claim 5, wherein one of the pair of conveying rollers has a member for depressing a center of the banknotes or the bundle of banknotes orthogonally to the longitudinal dimension, coaxially with another conveying roller.

* * * * *

UNITED STATES PATENT AND TRADEMARK OFFICE

CERTIFICATE OF CORRECTION

PATENT NO. : 8,196,916 B2
APPLICATION NO. : 13/011207
DATED : June 12, 2012
INVENTOR(S) : Yanagida et al.

It is certified that error appears in the above-identified patent and that said Letters Patent is hereby corrected as shown below:

In the Claims:

| | |
|---|---|
| Claim 4<br>Col. 9, II. 28-31 | After "and the holding plate," delete "is displayed on a display screen and a confirmation instruction of the displayed amount is entered by a user by pressing a button" and insert in its place --and the returned banknote or the bundle--. |

Signed and Sealed this
Twenty-second Day of January, 2013

David J. Kappos

David J. Kappos
*Director of the United States Patent and Trademark Office*